US007804385B2

(12) United States Patent
Snyder

(10) Patent No.: US 7,804,385 B2
(45) Date of Patent: Sep. 28, 2010

(54) COMPOSITE RESONATOR FOR USE IN TUNABLE OR FIXED FILTERS

(75) Inventor: Richard V. Snyder, Kinnelon, NJ (US)

(73) Assignee: RS Microwave Company, Butlet, NJ (US)

( * ) Notice: Subject to any disclaimer, the term of this patent is extended or adjusted under 35 U.S.C. 154(b) by 105 days.

(21) Appl. No.: 12/105,039

(22) Filed: Apr. 17, 2008

(65) Prior Publication Data

US 2008/0258847 A1 Oct. 23, 2008

Related U.S. Application Data

(60) Provisional application No. 60/925,491, filed on Apr. 20, 2007.

(51) Int. Cl.
*H01P 3/06* (2006.01)

(52) U.S. Cl. ..... 333/207; 333/243

(58) Field of Classification Search ..... 333/206, 333/207, 242, 243, 244; 174/100 R, 117 R, 174/117 FF, 262–266; 361/803
See application file for complete search history.

(56) References Cited

U.S. PATENT DOCUMENTS 2,511,610 A * 6/1950 Wheeler ..... 333/243
3,981,181 A * 9/1976 Ochiai ..... 73/40.5 R
4,847,450 A * 7/1989 Rupprecht ..... 174/143
5,227,749 A * 7/1993 Raguenet et al. ..... 333/246
6,377,142 B1 * 4/2002 Chiu et al. ..... 333/238
6,909,729 B2 * 6/2005 Ibanescu et al. ..... 372/6
7,112,747 B2 * 9/2006 Saito et al. ..... 174/152 G
7,421,910 B2 * 9/2008 Chen et al. ..... 73/862.451
2001/0028281 A1 10/2001 Miura et al.
2002/0101309 A1 8/2002 Chiu et al.
2004/0150494 A1 8/2004 Yoshida et al.

OTHER PUBLICATIONS

Lim, Sang-Kyu, "The Design of a Temperature-Stable Stepped-Impedance Resonator Using Composite Ceramic Materials," IEEE Microwave and Guided Wave Letters , vol. 9, No. 4, Apr. 1999.
Snyder, R. V., "A Compact, High Power Notch Filter with Adjustable $F_0$ and Bandwidth," IEEE Transactions on Microwave Theory and Techniques, vol. 42, No. 7, Jul. 1994.
Snyder, R. V., "Quasi-Elliptic Compact High-Power Notch Filters Using a Mixed Lumped and Distributed Circuit," IEEE Transactions on Microwave Theory and Techniques, vol. 47, No. 4, Apr. 1999.
International Search Report for International Application No. PCT/US2008/005030 dated Aug. 27, 2008.
Written Opinion of the International Searching Authority for International Application No. PCT/US2008/005030 dated Aug. 27, 2008.

* cited by examiner

*Primary Examiner*—Robert Pascal
*Assistant Examiner*—Kimberly E Glenn
(74) *Attorney, Agent, or Firm*—RatnerPrestia

(57) ABSTRACT

A fixed or tunable resonator. The resonator includes an inner conductor, a hollow outer conductor, and a hollow insulating layer. The hollow outer conductor forms a first inner space. The hollow insulating layer is formed from an outer soft dielectric layer, an inner soft dielectric layer, and a ceramic layer disposed between the soft dielectric layers. The hollow insulating layer includes a second inner space formed by the inner soft dielectric layer. The inner conductor is disposed within the second inner space of the hollow insulating layer, and the hollow insulating layer is disposed within the first inner space of the hollow outer conductor.

16 Claims, 5 Drawing Sheets

COMPOSITE RESONATOR FOR USE IN TUNABLE OR FIXED FILTERS

CROSS REFERENCE TO RELATED APPLICATIONS

This application claims priority from U.S. Provisional Application No. 60/925,491, filed Apr. 20, 2007, the contents of which are herein incorporated by reference in their entirety.

FIELD OF INVENTION

The present invention relates, in general, to tunable or fixed filters and, more specifically, to tunable or fixed filters including resonators having composite dielectrics.

BACKGROUND OF THE INVENTION

Coaxial transmission lines and coaxial resonators are used in many types of microwave and radio-frequency ("RF") filters, including both bandpass and bandstop implementations. Examples of prior-art tunable filters (herein also referred to as "factory adjustable filters") are documented in Snyder, R. V., "A Compact, High Power Notch Filter with Adjustable $F_0$ and Bandwidth," IEEE Transactions on Microwave Theory and Techniques, Vol. 42, No. 7, July 1994 and Snyder, R. V., "Quasi-Elliptic Compact High-Power Notch Filters Using a Mixed Lumped and Distributed Circuit," IEEE Transactions on Microwave Theory and Techniques, Vol. 47, No. 4, April 1999. These articles are incorporated herein by reference in their entirety.

Figure 1:
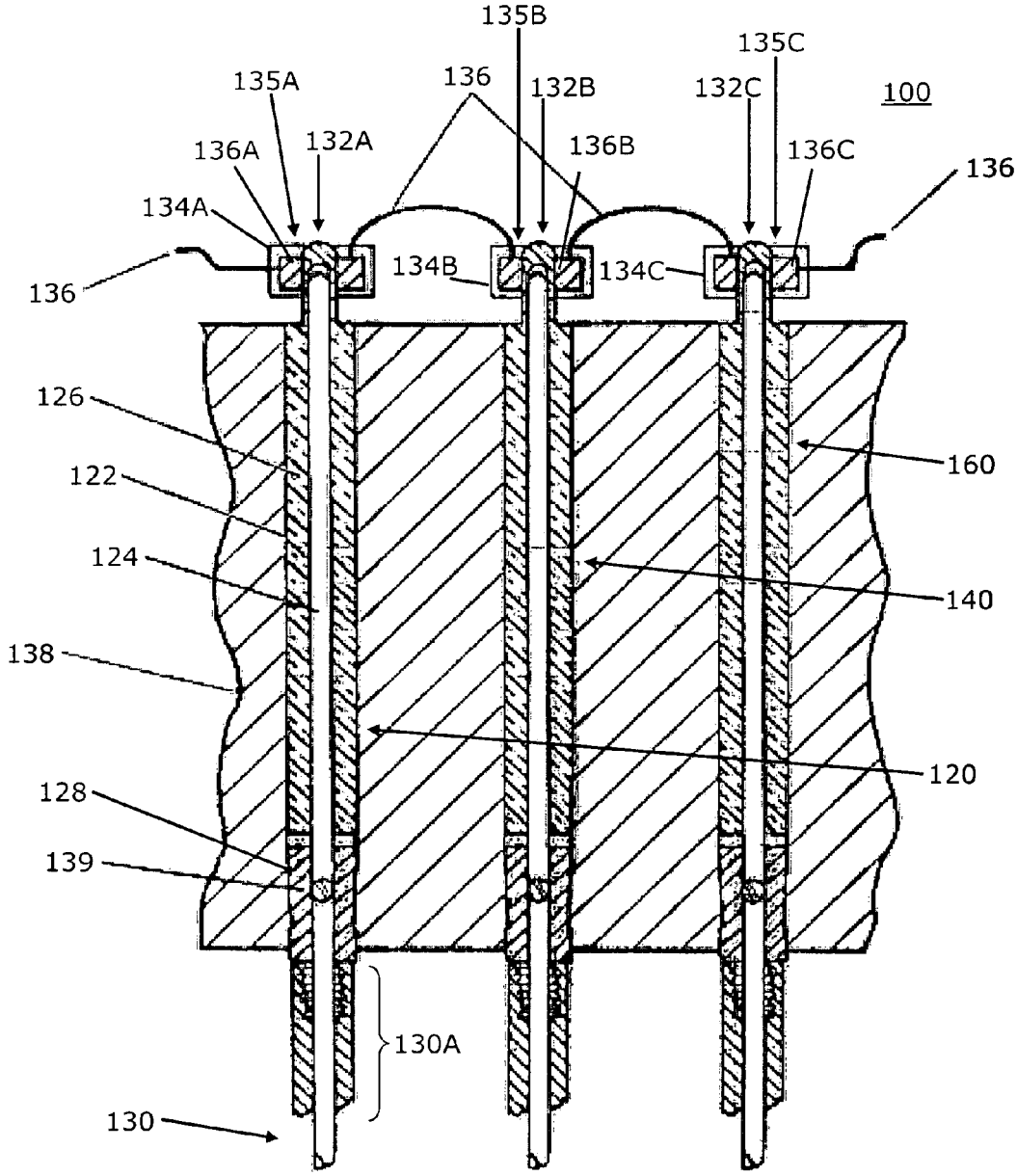
FIG. 1 Prior Art

FIG. 1 illustrates a prior-art factory adjustable notch filter 100 that utilizes prior-art factory adjustable coaxial resonators. Filter 100 comprises a plurality of coaxial resonators 120, 140, and 160, each of which are capacitively coupled to conductive loops 136 via respective plates 136A, 136B, and 136C. The capacitive couplings are illustrated in FIG. 1 as respective open circuits 132A, 132B, and 132C. Loops 136, which may be sections of coaxial cable, are capacitively coupled to ground by plates 134A, 134B, and 134C. Thus, plates 134A and 136A form a capacitor 135A; plates 134B and 136B form a capacitor 135B; and plates 134C and 136C form a capacitor 135C. Coaxial resonators 120, 140, and 160 are contained with a housing 138.

A description of the construction of coaxial resonator 120 will now be provided. It is understood that coaxial resonators 140 and 160 are similarly constructed. Coaxial resonator 120 comprises an outer conductor 122, an inner conductor 124, an insulating layer 126, a short circuiting mechanism 128 near end 130, and an open circuit 132A (described above) opposite end 130. Short circuiting mechanism 128 is secured to inner conductor 124 and slidably connects inner conductor 124 to outer conductor 122, thereby providing a short between outer conductor 122 and inner conductor 124. Extension 130A is disposed about inner conductor 124 between shorting mechanism 128 and end 130. Short circuit 128, insulating layer 126, open circuit 132A, and loading capacitor 135A connected between open circuit 132A and ground (not shown) determine the electrical length of resonator 120.

The dielectric properties of insulating layer 126 are important in the electrical length of resonator 120. In one prior-art embodiment (now described), insulating layer 126 is formed from a soft dielectric such as polytetrafluoroethylene (herein "PTFE" or "Teflon®"). In such an embodiment, the maximum dielectric constant of insulating layer 126 achievable is about 2.2, but unavoidable air gaps between conductors 122 and 124 and insulating layer 126 reduce this value to perhaps 2.0.

With respect to coaxial resonator 120, because insulating layer 126 is formed from PTFE which is lubricious, the assembly of inner conductor 124, short circuiting mechanism 128, and insulating layer 126 may be easily adjusted (slid in or out of outer conductor 122) to alter the effective electrical length of resonator 120. Extension 130A acts as a handle and aids in moving this assembly. Once adjusted, inner conductor 124 is secured by tightening set screw 139 to prevent further movement. Similar adjustments are made to coaxial resonators 140 and 160 to tune or adjust resonator 100.

As the ambient temperature of coaxial resonator 120 changes, the effective dielectric constant of insulating layer 126 also changes. This change in dielectric constant is due to the high thermal coefficient of expansion ("TCE") for PTFE, which TCE exceeds 100 parts per million ("PPM") per degree Centigrade. As the ambient temperature decreases, the PTFE in insulating layer 126 shrinks at a much great rate than conductors 122 and 124 (typical conductor TCE=20 PPM), thereby introducing air gaps (not shown) between insulating layer 126 and conductors 122 and 124. Because the dielectric constant of air is less than that of PTFE, the introduction of air gaps between insulating layer 126 and conductors 122 and 124 effectively reduces the dielectric constant of insulating layer 126. Conversely, as the ambient temperature increases, the higher rate of expansion for PTFE causes compression of the PTFE in insulating layer 126 between conductors 122 and 124. Because PTFE is a highly thermoplastic (and thus compressible) material, the effective dielectric constant of insulating layer 126 increases.

Figure 2:
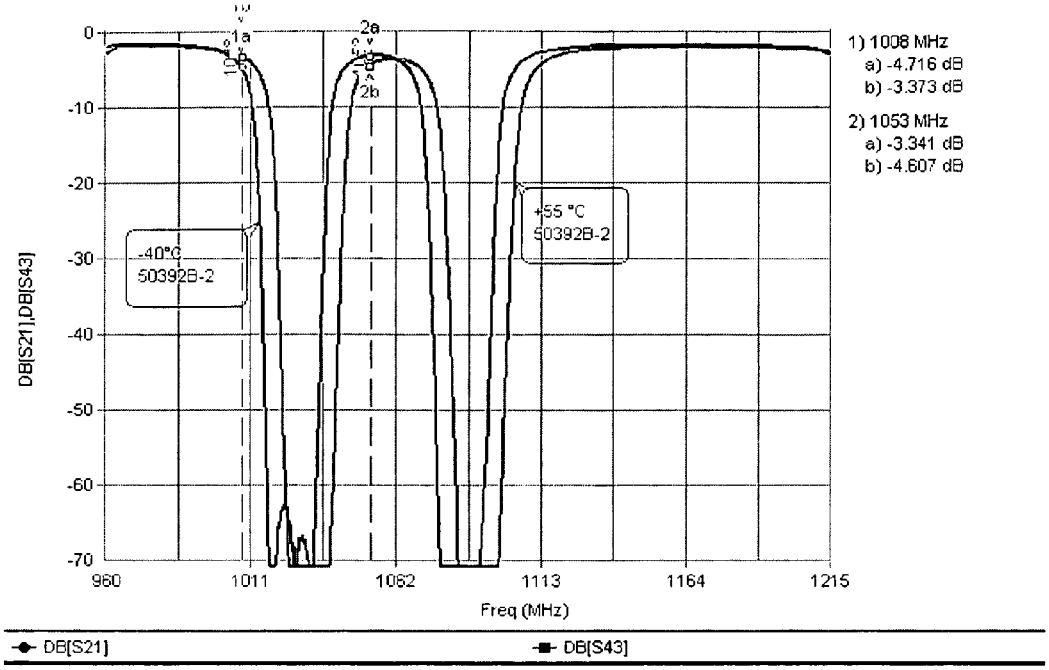
FIG. 2 Prior Art

FIG. 2 illustrates the frequency response of a conventional dual notch filter that uses the coaxial resonators described above with respect to FIG. 1. As can be seen in FIG. 2, as the temperature of the filter changes, the frequency response changes. For example, the attenuation of a 1008 MHz signal is −4.716 dB when the filter is at −40 C. When the temperature is raised to 55 C, the attenuation becomes −3.373 dB. The change in frequency response resulting from a change in temperature illustrates that the effective dielectric constants of the insulating layers of the resonators—and therefore the effective electrical lengths of the resonators—changes as temperature changes. Because of the effect of temperature on the frequency response, such filters must be designed with a "guardband," so that either rejection or insertion loss is maintained as temperature changes.

Coaxial resonators have applications in modern military hardware. The nominal electrical length of resonator 120 is determined by the maximum value of the dielectric constant of insulating layer 126. As described above, for PTFE and similar soft, i.e. plastic, dielectrics, that value is about 2.2. Thus, a resonator designed for an electrical length of 80 degrees at 1030 MHz would have a physical length of about 1.76 inches. Although the resonator need not be straight, a physical length of 1.76 inches per resonator is required to provide such an electrical length. The temperature variation of such an element is perhaps +/−1.5 MHz as temperature varies from −55 to +85 C, a typical military range requirement. The guardband (described above) accommodates this effect on the frequency response.

SUMMARY OF THE INVENTION

According to one aspect, an embodiment of the present invention includes a resonator that includes an inner conductor, a hollow outer conductor, and a hollow insulating layer. The hollow outer conductor forms a first inner space. The hollow insulating layer is formed from an outer soft dielectric layer, an inner soft dielectric layer, and a ceramic layer disposed between the soft dielectric layers. The hollow insulating layer includes a second inner space formed by the inner soft dielectric layer. The inner conductor is disposed within the second inner space of the hollow insulating layer, and the hollow insulating layer is disposed within the first inner space of the hollow outer conductor.

According to another aspect, an embodiment of the present invention includes a transmission line that includes a first conductor, a second conductor, and an insulating layer. The insulating layer includes first and second soft dielectric layers and a ceramic layer disposed between the first and second soft dielectric layers. The insulating layer is disposed between the first and second conductors so that the first soft dielectric layer is in contact with the first conductor and the second soft dielectric layer is in contact with the second conductor.

According to yet another aspect, an embodiment of the present invention includes a factory adjustable filter that includes a plurality of coaxial resonators and a plurality of conductive segments that couple adjacent coaxial resonators. Each of the plurality of coaxial resonators includes an inner conductor, a hollow outer conductor, and a hollow insulating layer. The hollow insulating layer includes an outer soft dielectric layer, an inner soft dielectric layer, and a ceramic layer disposed between the soft dielectric layers. The hollow outer conductor includes a first inner space, and the hollow insulating layer further includes a second inner space. The inner conductor is disposed within the second inner space of the hollow insulating layer, and the hollow insulating layer is disposed within the first inner space of the hollow outer conductor. A conductive short circuiting element connects the inner conductor to the hollow outer conductor.

According to still another aspect, an embodiment of the present invention provides a method of manufacturing a coaxial resonator. The method includes a step of providing a cylindrical inner conductor, a hollow cylindrical outer conductor comprising a first inner space, a hollow cylindrical ceramic comprising a second inner space, and first and second soft dielectric sheaths. The method also includes steps of encasing the cylindrical inner conductor with the second soft dielectric sheath to form a first assembly, and applying heat to the first assembly to shrink fit the second soft dielectric sheath about the cylindrical inner conductor. The method further includes steps of encasing the hollow cylindrical ceramic with the first soft dielectric sheath to form a second assembly, applying heat to the second assembly to shrink fit the first soft dielectric sheath about the hollow cylindrical ceramic, slidably disposing the first assembly within the second inner space of the hollow cylindrical ceramic to combine the first and second assemblies, and slidably disposing the combined first and second assemblies within the first inner space of the hollow cylindrical outer conductor.

DETAILED DESCRIPTION OF THE INVENTION

One way to reduce the effects of changing temperatures on the frequency response of resonator 100 is to use a ceramic, rather than a soft dielectric, as a dielectric in insulating layer 126. One particular ceramic that may be used is aluminum oxide ("alumina"), which is composed of 99.9% pure $Al_2O_3$. To be used as an insulating layer in a coaxial resonator, alumina must be formed as a tube so that inner conductor 124 may be disposed within it and outer conductor 122 may be disposed around it. Alumina is a hard material and is difficult to machine or form to achieve the tight tolerances (lack of any air gaps) necessary between outer conductor 122 and insulating layer 126 and between inner conductor 124 and insulating layer 126. Alumina does, however, exhibit a dielectric constant of 9.9, a very low TCE (about 5 PPM per degree C.), and very low dielectric loss tangent (about the same as PTFE, or perhaps 0.0002 at 1 GHz). The properties of alumina make its use in a factory adjustable coaxial resonator desirable to minimize the temperature effect on the frequency response of filter 100 discussed above.

Apart from the difficulty in holding to the tight tolerances, the use of alumina in place of PTFE in insulating layer 126 presents other difficulties, especially in applications for resonator 120. First, vibration and shock, sometimes severe, are ever-present in military hardware (an intended application), and often are readily transferred through outer conductor 122 and into the alumina of insulating layer 126, thereby causing cracking and failure of insulating layer 126. Second, temperature changes cause expansion or contraction of the conductors and the ceramic, and although the changes are small in the ceramic, compression of the ceramic due to conductor contraction changes can cause cracking and ultimate failure of the ceramic. Third, ceramic is not very lubricious, and motion of inner conductor 124 relative to outer conductor 122, as is required for tuning filter 100 into specification compliance, is very difficult because of the high coefficient of friction between conductors 122 and 124 and ceramic 126.

Figure 3:
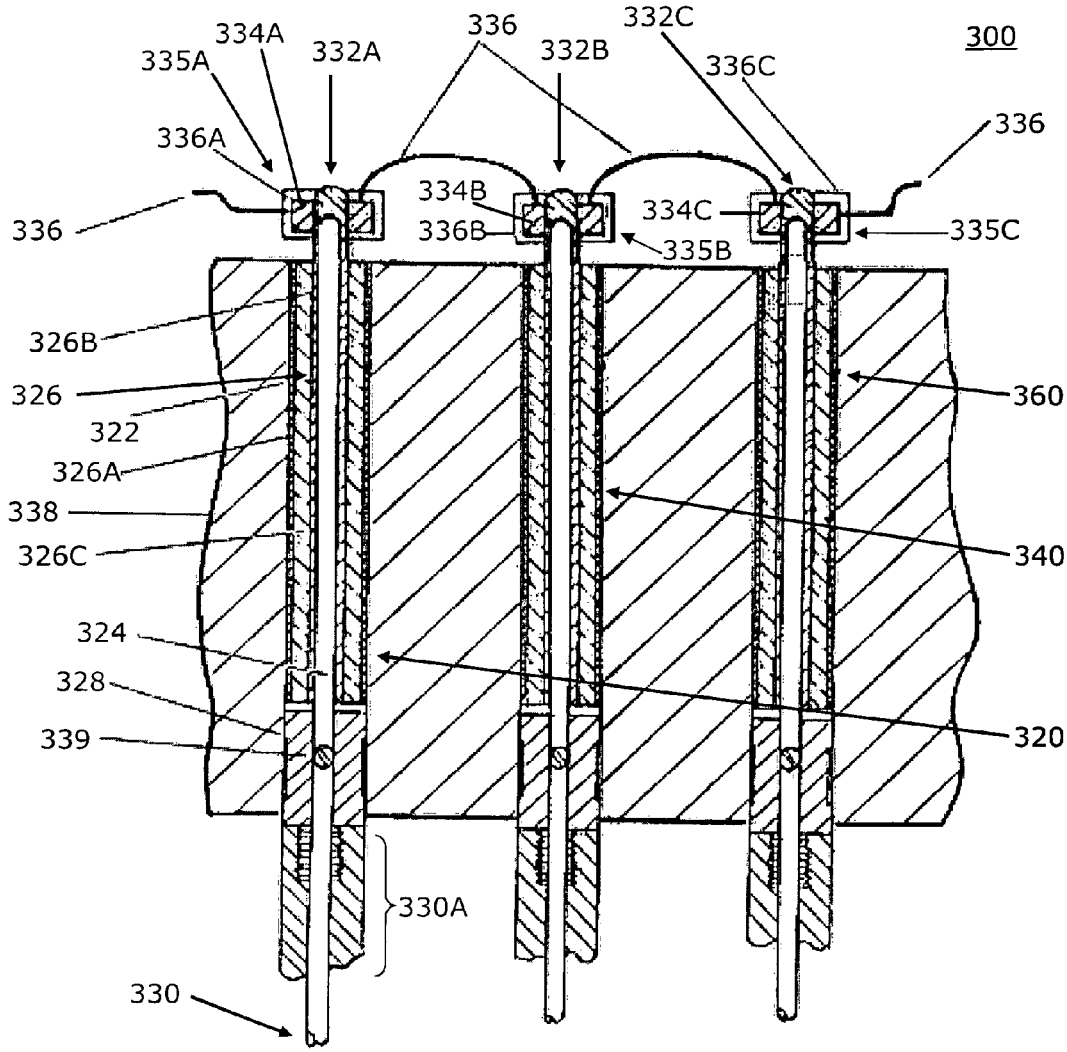

Referring now to FIG. 3, there is illustrated a tunable (factory adjustable) notch filter 300 in accordance with an embodiment of the present invention. Filter 300 comprises a plurality of coaxial resonators 320, 340, and 360, each of which are capacitively coupled to conductive loops 336 via respective plates 334A, 334B, and 334C. The capacitive couplings are illustrated in FIG. 3 as respective open circuits 332A, 332B, and 332C. Loops 336, which may be sections of coaxial cable, are capacitively coupled to ground by plates 336A, 336B, and 336C. Thus, plates 334A and 336A form a capacitor 335A; plates 334B and 336B form a capacitor 335B; and plates 334C and 336C form a capacitor 335C. Coaxial resonators 320, 340, and 360 are contained within housing 338.

A description of the construction of coaxial resonator 320 will now be made. It is understood that resonators 340 and 360 are similarly constructed. Coaxial resonator 320 comprises an outer conductor 322, an inner conductor 324, an insulating layer 326, a short circuiting mechanism 328 near end 330, and an open circuit 332A (described above) opposite end 330. Outer conductor 322 has a thin-walled cylindrical shape. Inner conductor 324 is a rod.

Short circuiting mechanism 328 is secured to inner conductor 324 and slidably connects inner conductor 324 to outer conductor 322, thereby providing a short between outer conductor 322 and inner conductor 324. Extension 330A is disposed about inner conductor 324 between shorting mechanism 328 and end 330. Short circuit 328, insulating layer 326, open circuit 332A, and loading capacitor 335A connected between open circuit 332A and ground (not shown) determine the electrical length of the resonator 320.

Insulating layer 326 is a composite dielectric layer comprising an outer soft dielectric 326A, an inner soft dielectric 326B, and a ceramic 326C disposed between outer soft dielectric 326A and inner soft dielectric 326B. As illustrated in FIG. 3, outer soft dielectric 326A is disposed between ceramic 326C and outer conductor 322, so that no portion of ceramic 326C is in contact with outer conductor 322. Likewise, inner soft dielectric 326B is disposed between ceramic 326C and inner conductor 324, so that no portion of ceramic 326C is in contact with inner conductor 324. In this way, inner conductor 324 is encased by a soft dielectric, as is ceramic 326C.

Although the space between ceramic 326C and outer conductor 322 and the space between ceramic 326C and inner conductor 324 are illustrated as being entirely filled by respective outer soft dielectric 326A and inner soft dielectric 326B such that all of the inner and outer surfaces of ceramic 326C are covered by soft dielectric, other coverage of the inner and outer surfaces of ceramic 326C is contemplated. For example, embodiments of notch filter 300 in which only portions of the inner and outer surfaces of ceramic 326C are covered by the soft dielectric are contemplated. In such embodiments, air fills the portions of the spaces between ceramic 326C and inner and outer conductors 324 and 322 not filled by the soft dielectric.

In an exemplary embodiment (now described), outer and inner soft dielectrics 326A and 326B are thin PTFE sleeves and ceramic 326C is a thick-walled, hollow cylindrical alumina tube. Using thin-walled PTFE sleeves allows the ceramic dielectric properties of ceramic 326C to dominate the performance of insulating layer 326, both electrically and thermally. PTFE sleeves 326A and 326B may be as thin as 0.010 inches. The effective dielectric constant of insulating layer 326 so constructed is computed based on the volume of PTFE ($e_r$=2.2) in soft dielectric layers 326A and 326B and alumina ($e_r$=9.9) in ceramic 326C. An exemplary value of this dielectric constant is 5.5.

PTFE sleeve 326A provides a lubricious barrier, allowing easier movement of inner conductor 324 and insulating layer 326 (specifically ceramic 326C) relative to outer conductor 322 during tuning as compared to coaxial resonators having no PTFE sleeve around a ceramic insulating layer. Furthermore, PTFE sleeves 326A and 326B provide vibration/shock dampening benefits among conductors 322, 324 and ceramic 326C, thereby reducing the possibility of cracking of ceramic 326C.

The plastic nature of PTFE sleeves 326A and 326B provides better thermal performance and/or less expensive manufacture of filter 300 over designs, such as in filter 100, using only ceramics or only PTFE in insulating layers of coaxial resonators. PTFE sleeves 326A and 326B compress as outer conductor 322 shrinks due to decreasing temperatures and expand as outer conductor 322 expands due to increasing temperatures. Therefore, PTFE sleeves 326A and 326B reduce the formation of air pockets in insulating layer 326 resulting from thermal expansion and contraction. Additionally, because PTFE is plastic, the sizing of ceramic 326C during manufacture need not be held to close tolerances as sleeves 326A and 326B may be sized to fill in rough areas of the inner and outer surfaces of ceramic 326C. Thus, costs associated with manufacturing ceramic 326C are reduced compared to ceramic 126.

The effective dielectric constant of insulating layer 326 can be customized by simply adjusting the wall thickness of ceramic 326C, the wall thicknesses of sleeves 326A and 326B, and the materials used in ceramic 326C and in sleeves 326A and 326B. For example, Delrin, ABS, rexolite, etc. may be used in sleeves 326A and 326B instead of the PTFE described above. Furthermore, ceramics, other than alumina, such as Barium Titanate (much higher $e_r$ than alumina), Boron Nitride, Beryllium Oxide (lower $e_r$ than alumina but better thermal conductivity), silica (silicon oxide), rutile (sapphire), etc. may be used in ceramic 326C instead of the alumina described above. Because inner conductor 324 and outer conductor 322 are insulated one from the other, application of a voltage between the inner and outer conductors is possible. Thus, the use of Barium Titanate would enable ferroelectrically tuned configurations.

Embodiments in which a ferromagnetic or ferroelectric insulator is used to form ceramic 326C are also contemplated. For example, YIG or another garnet material may be used to form ceramic 326C, thereby allowing filter 300 to be field tunable (as well as factory tunable) electronically, e.g., by application of a current. Additionally, using a ferroelectric material to form ceramic 326C also allows for filter 300 to be field tunable (as well as factory tunable) electronically, e.g., by application of a voltage.

Figure 4:
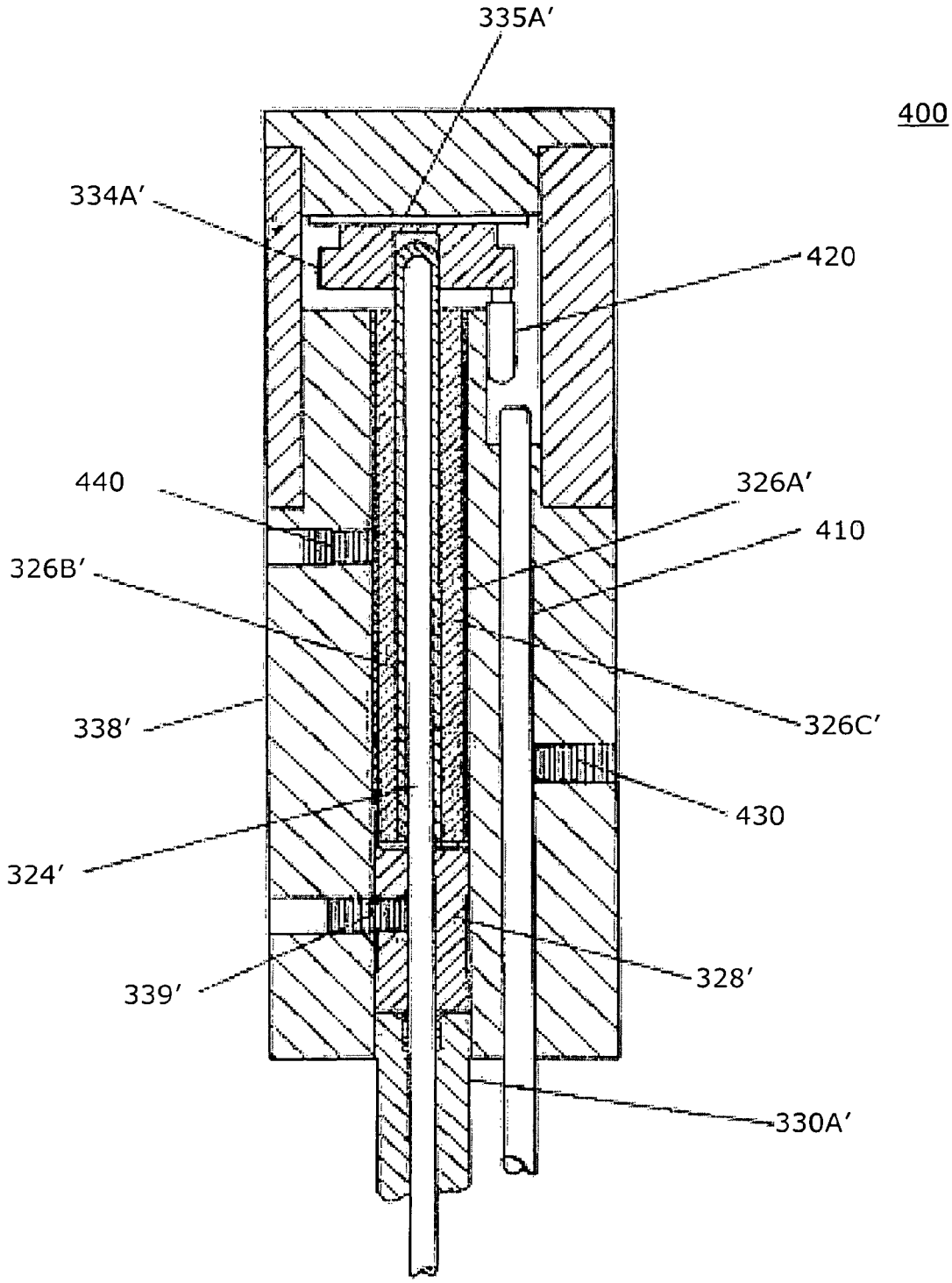

Referring now to FIG. 4, there is illustrated a coaxial resonator 400 in accordance with a further embodiment of the present invention. Coaxial resonator 400 includes a number of elements in common with resonator 300. These elements are numbered using the same numbers as in FIG. 3 with added apostrophes. The description of these elements of resonator 400 is incorporated herein from the description of the similar elements of resonator 300.

Resonator 400 includes a number of features not found in resonator 300. For example, resonator 400 does not include an outer conductor formed from a cylindrical thin-walled conductor. Instead, housing 338' acts as the outer conductor of resonator 400. Resonator 400 also includes a connecting inductor 420 and a tuning rod 410. Connecting inductor 420 provides an element of the series arm circuit connecting a multiplicity of resonators. The series arm circuit is low pass in response, providing the required phase shift between resonators (90 degrees at center frequency) and harmonic or spurious resonance suppression because of the low pass nature of the series circuit. Tuning rod 410 is used to modify the effective value of the connecting inductor 420, allowing for faster adjustment of the filter during manufacture. A set screw 430 is used for setting the position of tuning rod 410, and a set screw 440 is used for setting the position of insulating layer 326'.

Figure 5:
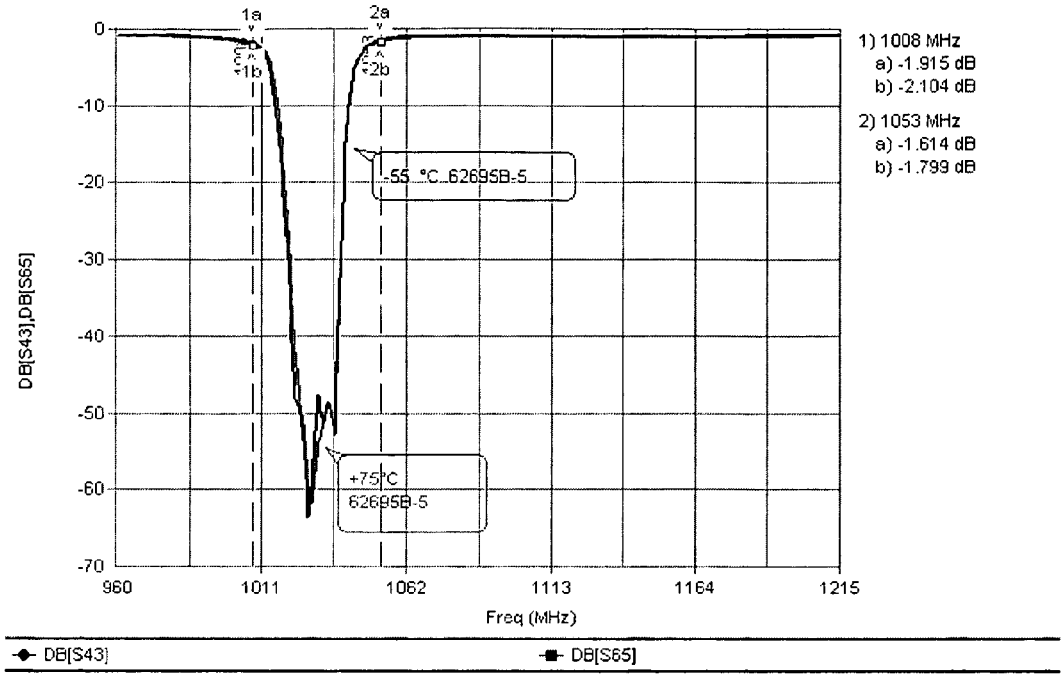

FIG. 5 illustrates the frequency response of a single notch filter that uses the coaxial resonators described above with respect to FIG. 3. As can be seen in FIG. 5, as the temperature of the single notch filter changes, the frequency response changes less than that observed in prior-art notch filters (see FIG. 2). For example, as seen in FIG. 5, the attenuation of a 1008 MHz signal is −1.915 dB when the filter is at −55 C. When the temperature is raised to 75 C, the attenuation becomes −2.104 dB. The change in attenuation is significantly less than that in the prior-art dual notch filter because ceramic (alumina) layer 326C has a lower TCE than PTFE and because soft dielectric (PTFE) layers 326A and 326B substantially fill in any air gaps that would have formed in their absence.

Compared to prior-art resonators, the length of resonator 320, configured as a 1030 MHz resonator, is reduced from 1.76 inches (the length of the prior-art resonator) to 1.09 inches. Because the TCE for alumina is less than 5% that of PTFE, the guardband of resonator 320 can be reduced from +/−1.5 MHz (the size of the prior-art guardband) to approximately +/−0.2 MHz. The reduction in the guardband provides quite an advantage for the designer, possibly reducing the order of the filter and thus reducing size and improving performance.

It is contemplated that the application of resonators 320, 340, 360, 400, etc. is not limited to notch filters but may include high power bandpass filters. Additionally, although resonators 320, 340, 360, and 400 are described as coaxial resonators, any factory adjustable resonator, or factory adjustable transmission line for that matter, in which a ceramic insulator may be used may benefit from the soft-dielectric encasing described herein.

An exemplary method of manufacturing coaxial resonator 320 is now described. Although the steps below are described in a certain order, it is appreciated that the ordering of the steps may be altered as logical while still resulting in a manufactured coaxial resonator in accordance with an embodiment of the present invention. It is understood that the steps described below are applicable for manufacturing coaxial resonator 400 illustrated in FIG. 4.

To begin, soft dielectric (PTFE) sleeve or shrink tubing 326B is placed around inner conductor 324, i.e. slipped over an outer surface of inner conductor 324. In an exemplary embodiment in which inner conductor 324 has a cylindrical shape (solid or otherwise), soft dielectric sleeve 326B has a hollow thin-walled cylindrical shape having an inner diameter approximately equal to the diameter of inner conductor 324. Heat is applied to the encased inner conductor 324 to shrink fit soft dielectric sleeve 326B around inner conductor 324. In this way, soft dielectric sleeve 326B is mechanically secured to inner conductor 324. No adhesives, sintering, etc. are required.

Soft dielectric sleeve or shrink tubing 326A is placed around ceramic 326C, i.e. slipped over the outer surface of ceramic 326C. In an exemplary embodiment, ceramic 326C has a thick-walled cylindrical shape with an internal hollow cylindrical cavity sized to accept the soft dielectric sleeve 236B/inner conductor 324 construction. Soft dielectric sleeve 326A has a hollow thin-walled cylindrical shape having an inner diameter approximately equal to the outer diameter of ceramic 326C. Heat is applied to the encased ceramic 326C to shrink fit soft dielectric sleeve 326A around ceramic 326C. In this way, soft dielectric sleeve 326A is mechanically secured to ceramic 326C without the need for adhesives, sintering, etc.

Short circuiting mechanism 328 is selected to be cylindrically shaped, with an outer diameter approximately equal to or slightly less than the soft dielectric sleeve 326A/ceramic 326C construction and an internal hollow cylindrical cavity sized to accommodate inner conductor 324. Short circuiting mechanism 328 is then inserted over inner conductor 324 and secured thereto. The soft dielectric sleeve 236A/ceramic 326C construction is then slid over the soft dielectric sleeve 326B/inner conductor 324 construction, and short circuiting mechanism 328 is secured to ceramic 326C.

Next, outer conductor 322 is selected for assembly into coaxial resonator 320. In an exemplary embodiment, outer conductor 322 has a hollow cylindrical shape and is sized such that its inner diameter snugly accommodates the encased ceramic 326C and short circuiting mechanism 328 construction. After being selected, outer conductor 322 is slid onto the soft-dielectric encased ceramic 326C. Extension 330A may then be affixed to inner conductor 324. The assembled coaxial resonator 320 may be placed into a filter, such as filter 300.

During tuning, extension 330A is operated so that insulating layer 326, short circuiting mechanism 328, and inner conductor 324 slide as a unit toward open circuit 332A of resonator 320 or away from open circuit 332A. Soft dielectric layer 326A, being lubricious in nature, acts as a bearing for insulating layer 326 (specifically, ceramic 326C) as it moves relative to outer conductor 322. Thus, the lubricious nature of soft dielectric layer 326A assists in the tuning of resonator 320. When the desired length of resonator 320 is achieved, extension 330A may be trimmed off to hinder further adjustments, whether intentional or not, of the length of resonator 320.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. A transmission line comprising:

a first conductor;

a second conductor; and an insulating layer comprising first and second soft dielectric layers and a ceramic layer disposed between the first and second soft dielectric layers, wherein the insulating layer is disposed between the first and second conductors so that the first soft dielectric layer is in contact with the first conductor and the second soft dielectric layer is in contact with the second conductor, and the insulating layer is slidably disposed between the first and second conductors;

wherein the insulating layer is securely attached to the first conductor and slidably coupled to the second conductor.

2. The transmission line of claim 1, wherein:

the first soft dielectric layer being disposed between the first conductor and the ceramic layer to prevent contact between the first conductor and the ceramic layer, and the second soft dielectric layer being disposed between the second conductor and the ceramic layer to prevent contact between the second conductor and the ceramic layer.

3. The transmission line of claim 1, wherein the first and second soft dielectric layers are formed from PTFE and the ceramic layer is formed from one or more of alumina, barium titanate, boron nitride, beryllium oxide, silica, rutile, and YIG.

4. A resonator comprising:

an inner conductor;

a hollow outer conductor comprising a first inner space; and a hollow insulating layer comprising an outer soft dielectric layer, an inner soft dielectric layer, and a ceramic layer disposed between the soft dielectric layers, the hollow insulating layer further comprising a second inner space formed by the inner soft dielectric layer, wherein the inner conductor is disposed within the second inner space of the hollow insulating layer and the hollow insulating layer is disposed within the first inner space of the hollow outer conductor, and the hollow insulating layer is slidably disposed between the inner conductor and the hollow outer conductor;

wherein the hollow insulating layer is securely attached to the inner conductor and slidably coupled to the hollow outer conductor.

5. The resonator of claim 4, further comprising a conductive short circuiting element in electrical contact with the inner conductor and the hollow outer conductor.

6. The resonator of claim 4, wherein the inner conductor has a wire shape, the hollow outer conductor has a hollow cylindrical shape, and the hollow insulating layer has a hollow cylindrical shape.

7. The resonator of claim 4, wherein:

the ceramic layer comprises an inner surface and an outer surface, the outer soft dielectric covers at least a portion of the outer surface of the ceramic layer, and the inner soft dielectric covers at least a portion of the inner surface of the ceramic layer.

8. The resonator of claim 7, wherein the inner soft dielectric is shrink fit to the inner conductor.

9. The coaxial resonator of claim 7, wherein the inner soft dielectric is attached to the inner surface of the ceramic layer.

10. The resonator of claim 4, further comprising an extension affixed to the inner conductor.

11. A tunable filter comprising:

a plurality of coaxial resonators, each comprising:

an inner conductor, a hollow outer conductor comprising a first inner space, a hollow insulating layer comprising an outer soft dielectric layer, an inner soft dielectric layer, and a ceramic layer disposed between the soft dielectric layers, the insulating layer further comprising a second inner space formed by the inner soft dielectric layer, the inner conductor being disposed within the second inner space of the hollow insulating layer and the hollow insulating layer being disposed within the first inner space of the hollow outer conductor, and a conductive short circuiting element configured to connect the inner conductor to the outer conductor; and a plurality of conductive segments, each of which couple adjacent coaxial resonators.

12. The tunable filter of claim 11, wherein, for each of the plurality of coaxial resonators, the insulating layer is slidably disposed between the inner conductor and the hollow outer conductor.

13. The tunable filter of claim 11, wherein, for each of the plurality of coaxial resonators:

the inner soft dielectric layer being disposed between the inner conductor and the ceramic layer to prevent contact between the inner conductor and the ceramic layer, and the outer soft dielectric layer being disposed between the hollow outer conductor and the ceramic layer to prevent contact between the hollow outer conductor and the ceramic layer.

14. The tunable filter of claim 11, wherein each of the plurality of coaxial resonators further comprises an extension affixed to the inner conductor.

15. A method of manufacturing a coaxial resonator comprising:

providing a cylindrical inner conductor;

providing a hollow cylindrical outer conductor comprising a first inner space;

providing a hollow cylindrical ceramic comprising a second inner space;

providing first and second soft dielectric sheaths;

encasing the cylindrical inner conductor with the second soft dielectric sheath to form a first assembly;

applying heat to the first assembly to shrink fit the second soft dielectric sheath about the cylindrical inner conductor;

encasing the hollow cylindrical ceramic with the first soft dielectric sheath to form a second assembly;

applying heat to the second assembly to shrink fit the first soft dielectric sheath about the hollow cylindrical ceramic;

slidably disposing the first assembly within the second inner space of the hollow cylindrical ceramic to combine the first and second assemblies; and slidably disposing the combined first and second assemblies within the first inner space of the hollow cylindrical outer conductor.

16. The method of claim 15, further comprising connecting the inner and outer conductors by a short circuit.

* * * * *